US006250288B1

(12) United States Patent
Fritz

(10) Patent No.: US 6,250,288 B1
(45) Date of Patent: Jun. 26, 2001

(54) METHOD FOR CHECKING THE OPERABILITY OF A TANK-VENTING SYSTEM OF A VEHICLE

(75) Inventor: Thorsten Fritz, Gaggenau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/372,060

(22) Filed: Aug. 11, 1999

(30) Foreign Application Priority Data

Aug. 11, 1998 (DE) ..... 198 36 295

(51) Int. Cl.[7] ..... F02M 33/02
(52) U.S. Cl. ..... 123/520; 123/198 D; 73/118.1
(58) Field of Search ..... 123/198 D, 520, 123/519, 518, 521, 516; 73/118.1, 46

(56) References Cited

U.S. PATENT DOCUMENTS 5,353,771 * 10/1994 Blumenstock et al. ..... 123/520
5,499,614 * 3/1996 Busato et al. ..... 123/520
5,505,182 * 4/1996 Denz et al. ..... 123/520
5,553,577 * 9/1996 Denz et al. ..... 123/198 D
5,572,981 * 11/1996 Pfleger et al. ..... 123/698
5,666,925 * 9/1997 Denz et al. ..... 123/520
5,685,279 * 11/1997 Blomqist et al. ..... 123/520
5,794,599 * 8/1998 Blumenstock ..... 123/519
5,890,474 4/1999 Schnaibel ..... 123/520
6,035,708 * 3/2000 Blumenstock ..... 73/118.1

* cited by examiner

*Primary Examiner*—Henry C. Yuen
*Assistant Examiner*—Mahmoud Gimie
(74) *Attorney, Agent, or Firm*—Walter Ottesen

(57) ABSTRACT

The invention is directed to a method for checking the operability of a tank-venting system of a vehicle. A pressure source is operatively connected to the tank-venting system and a first fill level of the tank is determined and stored at the start of a standstill of the vehicle. An overpressure relative to atmospheric pressure is introduced into the tank-venting system during the standstill of the vehicle and an operating characteristic variable of this pressure source is detected as the overpressure is introduced into the tank-venting system. A conclusion as to the presence of a leak in the tank-venting system is drawn from the operating characteristic variable. A second fill level of the tank at the end of the standstill is determined and stored. The difference of the first and second fill levels is formed and a determination is made as to whether the difference exceeds a pregiven threshold value; and, only if the threshold value is exceeded, a fault announcement is outputted.

7 Claims, 3 Drawing Sheets

METHOD FOR CHECKING THE OPERABILITY OF A TANK-VENTING SYSTEM OF A VEHICLE

FIELD OF THE INVENTION

The invention relates to a method for checking the operability of a tank-venting system of a motor vehicle. The tank-venting system includes a tank and an absorption filter which has a venting line. The adsorption filter is connected to the tank via a connecting line and the system also includes a tank-venting valve which is connected to the adsorption filter via a valve line. In the method, an overpressure compared to ambient pressure is introduced into the system and at least one operating characteristic variable is detected when introducing the overpressure for determining the pressure trace and a conclusion is drawn as to the presence of a leak (tightness check). The operating characteristic variable which is detected is preferably of the pressure source.

BACKGROUND OF THE INVENTION

A method and an arrangement of this kind for checking the operability of a tank-venting system is disclosed, for example, in U.S. Pat. No. 5,890,474 as well as in U.S. Pat. No. 6,131,550.

From U.S. Pat. No. 6,131,550, a method is known wherein the time-dependent trace of at least one operating characteristic variable is detected during standstill of the vehicle and this variable is compared to a previously measured, computed or estimated time-dependent trace of the at least one operating characteristic variable which is not disturbed by a tanking operation. A fault announcement is not outputted when the detected time-dependent trace deviates by a pregivable value from the diagnostic trace. The operating characteristic variable is advantageously the electric current of an overpressure pump with which an overpressure is generated in the tank-venting system.

For this method, it is problematic that the time-dependent trace of the operating characteristic variable must be continuously detected and compared to a computed, stored or measured operating characteristic variable. A leak is here only detected when a significant change of the operating characteristic value is detected within this diagnostic trace.

It is not infrequent that the driver of a motor vehicle, for example, stops at a gas station, switches off the engine, opens the cap of the tank but does not immediately start tanking. In this case, the tightness check starts with the standstill of the vehicle and erroneously determines a leak because of the removed tank cap which leak is no longer present after the tanking operation and the closing of the tank. In a case such as this, an erroneous entry into a memory of a control apparatus or the like should be avoided. In the arrangement disclosed in U.S. Pat. No. 6,131,550, an opening of the tank can only be detected when this takes place during the course of a diagnosis. For this reason, a tank, which has already been opened in advance of the diagnostic sequence, cannot be distinguished from an actually present leak in the tank-venting system.

SUMMARY OF THE INVENTION

In view of the foregoing, it is an object of the invention to improve a method for checking the operability of a tank-venting system in such a manner that an erroneously diagnosed leak based on an improper use of the vehicle can be reliably detected.

The method of the invention is for checking the operability of a tank-venting system of a vehicle having an engine.

The tank-venting system includes: a tank; an adsorption filter having a venting line; a first connecting line connecting the adsorption filter to the tank; a tank-venting valve; and, a second connecting line connecting the tank-venting valve to the adsorption filter. The method includes the steps of: providing a pressure source and operatively connecting the pressure source to the tank-venting system; determining and storing a first fill level of the tank at the start of a standstill of the vehicle; introducing an overpressure relative to atmospheric pressure into the tank-venting system during the standstill of the vehicle; detecting an operating characteristic variable of the pressure source as the overpressure is introduced into the tank-venting system; drawing a conclusion as to the presence of a leak in the tank-venting system from the operating characteristic variable; determining and storing a second fill level of the tank at the end of the standstill; forming the difference of the first and second fill levels and determining whether the difference is less than a pregiven threshold value; and, only if the difference is less than the threshold value, outputting a fault announcement.

An actually present leak can be distinguished from an erroneous leak based on an open tank cap by means of the detection of the fill level of the tank at the start of the standstill of the vehicle and at the end of the standstill in a simple and advantageous manner. In this context, it is of no significance whether the tank was impermissibly open over a longer time duration as described above or was open only for the actual tanking operation.

In each case, a significant change of the tank fill level is detected for a tanking operation so that the presence of such a change permits a conclusion to be drawn as to a tanking operation and therefore to an opening of the tank. The end of the standstill can then be determined in various ways.

In an advantageous embodiment, it is provided that the end of the standstill is defined as a renewed start of the engine.

In another very advantageous embodiment of the invention, it is provided that the end of the standstill is defined as the renewed start of the vehicle and the travel over a pregiven road distance or the elapse of a pregivable duration of operation of the engine. This embodiment affords especially the advantage that erroneously outputted leak announcements, which occur during driving with an open tank (for example in the vicinity of a gas station), can be excluded.

If the driver opens the tank at a gas station and moves the vehicle with the open tank to advance, for example, in a waiting line, then, for a definition of the end of standstill as a renewed start of the engine, an incorrectly outputted leak announcement cannot be precluded which is based on such an improper operation of the vehicle during a tanking operation. In this case, a leak announcement would be outputted because the end of standstill would be detected by the renewed start of the engine and, even after the standstill of the vehicle, an open tank would be present and therefore a leak would be outputted.

The above would be precluded by the above-mentioned advantageous embodiment in that the end of standstill is defined only after a pregiven distance has been traveled which, for example, could be five hundred meters or the like.

In principle, the most different operating characteristic variables can be considered with respect to the detection of the time-dependent trace of the operating characteristic variables of the pressure source.

An advantageous embodiment provides that the electric current of an overpressure pump is detected as an operating characteristic variable of the pressure source. By detecting the current, not only can significant changes of the operating state of the pressure source be precisely detected but the detected current can also be processed in an especially advantageous and simple manner.

The fill level can be advantageously determined in one or more of the following ways: with a fill level transducer; from the injected fuel quantity determined by an engine control; and, with contactless fill level sensors.

BRIEF DESCRIPTION OF THE DRAWINGS

The invention will now be described with reference to the drawings wherein.

DESCRIPTION OF THE PREFERRED EMBODIMENTS OF THE INVENTION

Figure 3:
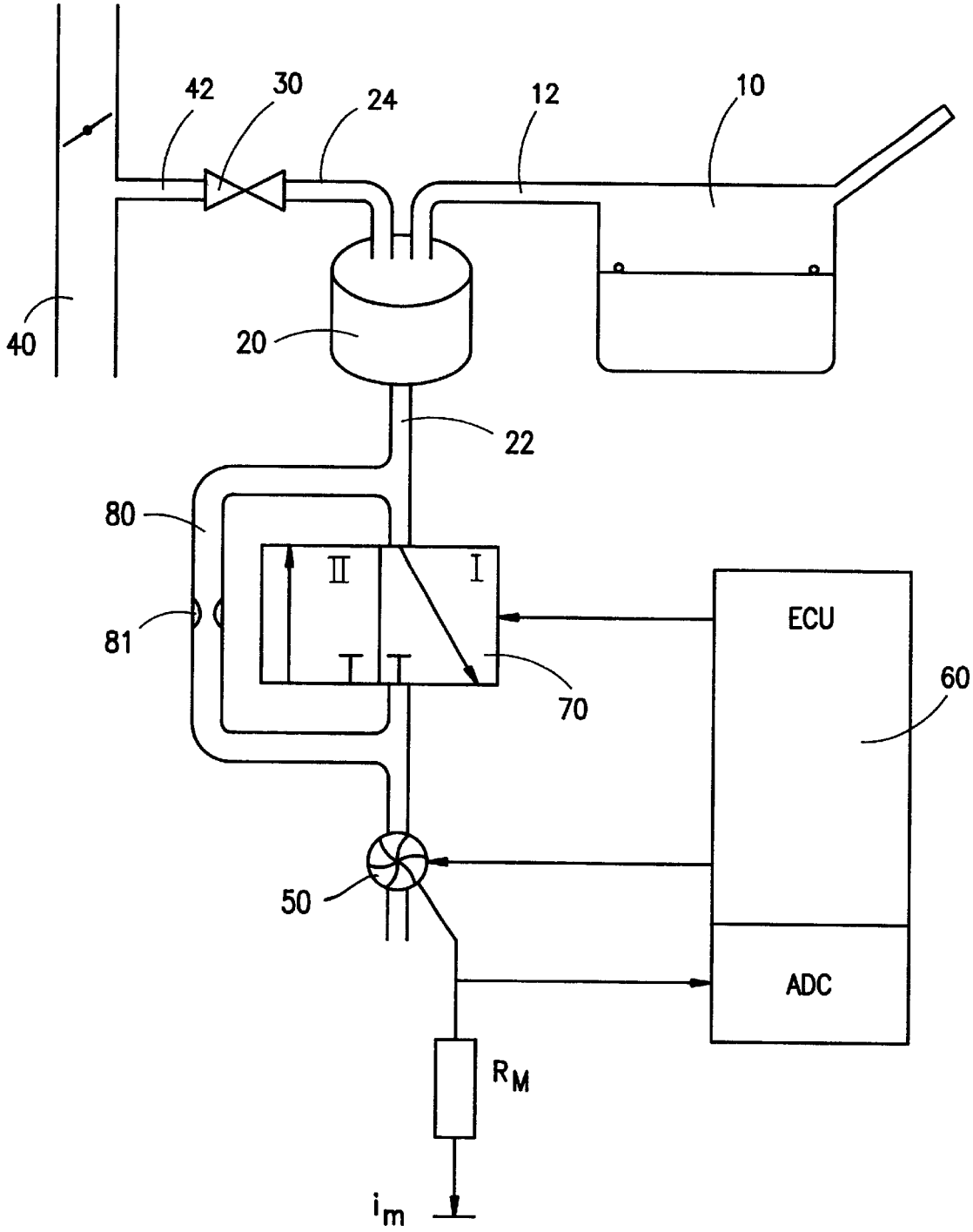

A tank-venting system of a motor vehicle tank system is shown in FIG. 3 and includes a tank 10, an adsorption filter 20 such as an active charcoal filter and a tank-venting valve 30. The adsorption filter 20 is connected to the tank 10 via a tank-connecting line 12 and has a venting line 22 which can be connected to the ambient. The tank-venting valve 30 is, on the one hand, connected to the adsorption filter 20 via a valve line 24 and, on the other hand, is connected to an intake manifold 40 of an engine (not shown) via a valve line 42.

Hydrocarbons develop in the tank 10 because of vaporization and these hydrocarbons deposit in the adsorption filter 20. To regenerate the adsorption filter 20, the tank-venting valve 30 is opened so that air of the atmosphere is drawn by suction through the adsorption filter 20 because of the underpressure present in the intake manifold 40 whereby the hydrocarbons deposited in the adsorption filter are drawn by suction into the intake manifold 40 and are conducted to the engine.

A pump 50 is provided for making a diagnosis as to the operability of the tank-venting system. The pump is connected to a circuit unit 60 (electronic control unit or ECU). The pump 50 is connected to a switchover valve 70, for example, in the form of a three/two-directional valve. A reference leak 81 is arranged in a separate branch 80 parallel to this switchover valve 70. The size of the reference leak 81 is so selected that it corresponds to the size of the leak to be detected.

It is understood that the reference leak 81 can, for example, be a part of the switchover valve 70 as a departure from the illustrated embodiment. The reference leak 61 can be in the form of a channel constriction or the like so that an additional reference part is unnecessary in this case.

The tightness check of the tank-venting system is described in detail in U.S. Pat. No. 5,890,474 which is incorporated herein by reference. By detecting the current to be supplied to the pump motor it can be determined whether the flow rate, which is to be introduced into the tank-venting system by the pump 50, deviates from the flow rate which is present for introducing the overpressure via the reference leak 81.

An embodiment of the method of the invention will now be described with respect to FIG. 1.

First, a determination is made in step S10 as to whether the engine is switched off. If this is the case, the fill level is detected and stored (step S11). This can, for example, take place as follows: by detecting the output signal of a fill level transducer; by detecting the injected fuel quantity determined by the engine control; by detecting the distance traveled; by a contactless fill level measurement such as by ultrasonic sensors; by determining the weight of the tank or the like.

The tightness check takes place in step S12 as described in U.S. Pat. No. 5,890,474 or U.S. Pat. No. 6,131,550, which are incorporated herein by reference.

In step S13, it is determined whether a renewed engine start is present. If this is the case, a further detection and storage of the tank fill level takes place in step S14. In step S15, the difference of the detected and stored fill levels is determined. In step S16, a determination is made as to whether the difference exceeds a pregiven threshold value.

If this is the case, then no fault announcement is outputted (step S17) because, in this case, it must be assumed that a tank operation has taken place in the standstill phase of the vehicle, that is, after the engine was switched off and before the engine was restarted, and this tanking operation has led to a significant change of the fill level of the tank.

If, in contrast, the difference is not greater than the threshold value, then it must be presumed that a leak is present. In this case, the output of a fault announcement takes place in step S18.

Figure 1:
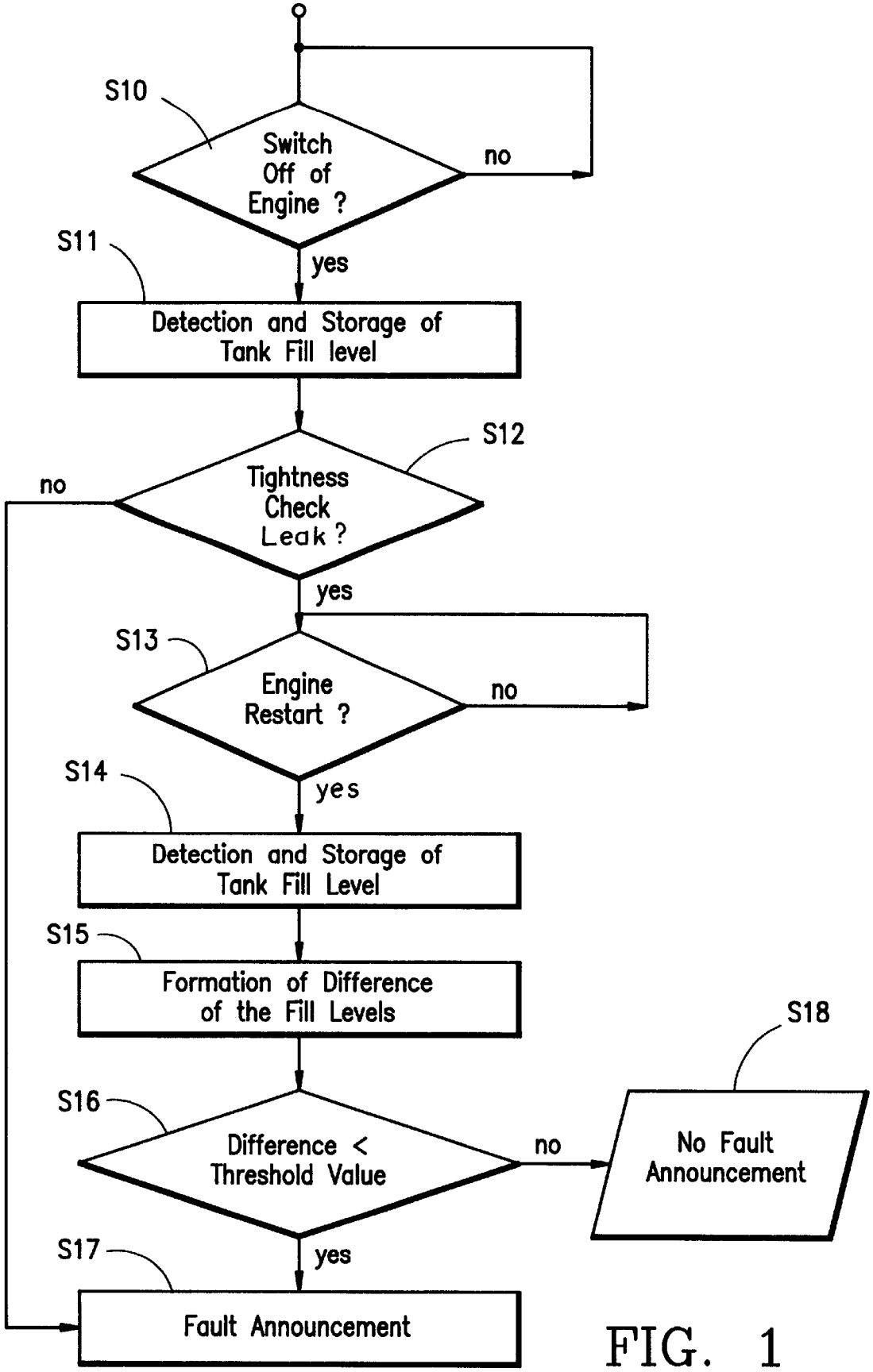
FIG. 1 is a flowchart of an embodiment of the method of the invention.
Figure 2:
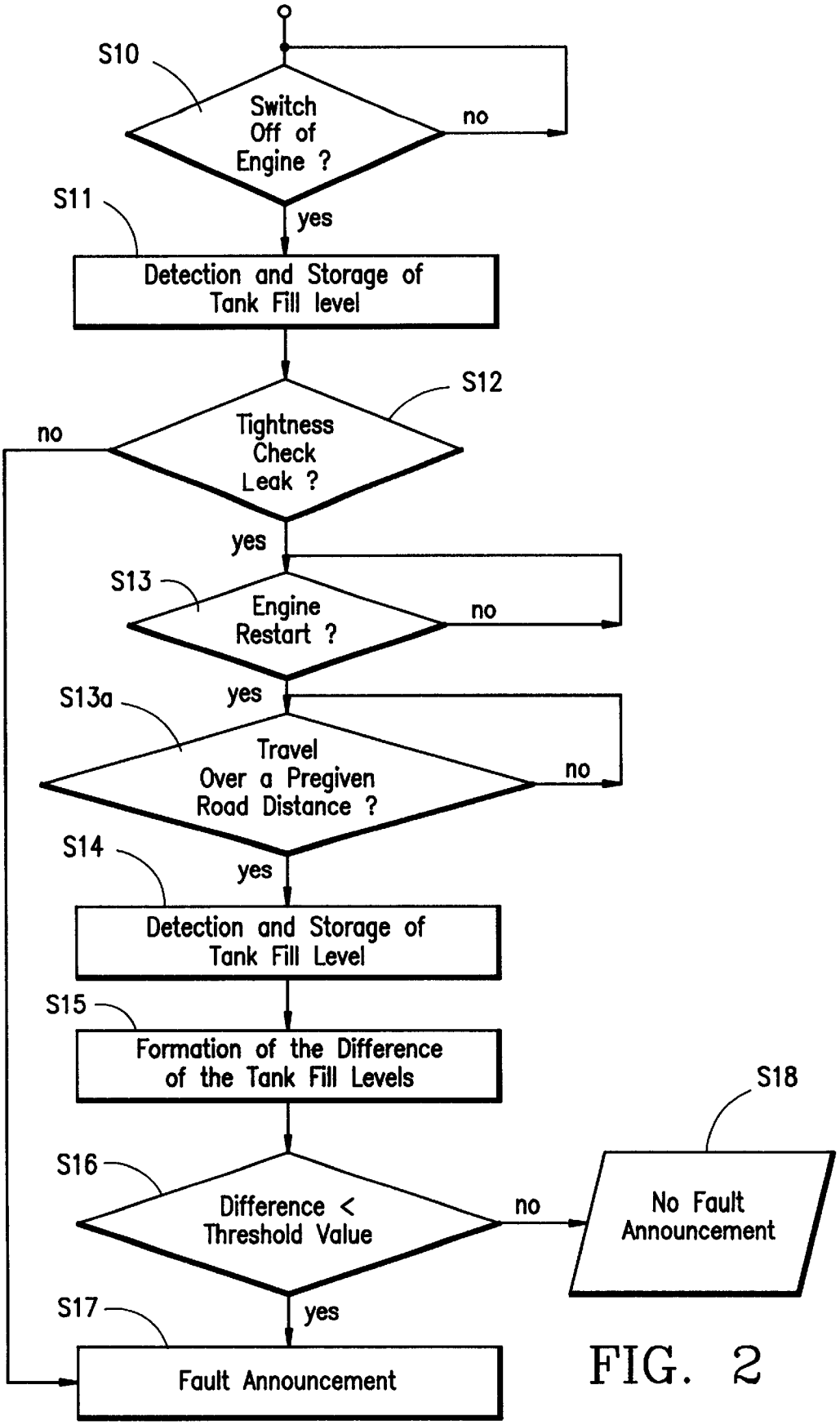
FIG. 2 is a flowchart showing a further embodiment of the method of the invention; and, FIG. 3 is a schematic of a tank-venting system wherein the method of the invention can be applied.

The embodiment shown in FIG. 2 differs from the embodiment shown in FIG. 1 only in that, in addition to step S13, in which a check is made as to whether a renewed engine start is present, first in a further step S13*a,* a check is made as to whether the vehicle has passed over a pregivable path distance. If this is the case, then the above-described steps S14 to S18 again follow.

The check as to whether the vehicle has covered a pregivable road distance (step S13*a*) has the advantage that even driving with an open tank (for example, when the driver must queue with the vehicle at a gas station and has already opened the cap to the tank before driving up to the pump) is not detected as an error but as an erroneous operation of the vehicle. In this case, a fault announcement is only outputted when the vehicle has passed over a pregiven road distance and when, at the same time, a leak is discovered.

It is understood that the foregoing description is that of the preferred embodiments of the invention and that various changes and modifications may be made thereto without departing from the spirit and scope of the invention as defined in the appended claims.

What is claimed is:

1. A method for checking the operability of a tank-venting system of a vehicle having an engine, the tank-venting system including: a tank; an adsorption filter having a venting line; a first connecting line connecting said adsorption filter to said tank; a tank-venting valve; and, a second connecting line connecting said tank-venting valve to said adsorption filter, the method comprising the steps of:

providing a pressure source and operatively connecting said pressure source to said tank-venting system;

determining and storing a first fill level of said tank at the start of a standstill of said vehicle;

introducing an overpressure relative to atmospheric pressure into said tank-venting system during said standstill of said vehicle;

detecting an operating characteristic variable of said pressure source as said overpressure is introduced into said tank-venting system;

drawing a conclusion as to the presence of a leak in said tank-venting system from said operating characteristic variable;

determining and storing a second fill level of said tank at the end of said standstill of said vehicle;

forming the difference of said first and second fill levels and determining whether said difference is less than a pregiven threshold value; and, only if said difference is less than said threshold value, outputting a fault announcement.

2. The method of claim 1, comprising the further step of defining the end of said standstill as a restart of said engine.

3. The method of claim 1, comprising the further step of defining the end of said standstill as a restart of said engine and at least one of the following events: a travel of said vehicle over a pregiven road distance and an elapse of a pregiven duration of operation of said engine.

4. The method of claim 1, wherein said pressure source is an electric overpressure pump; and, said operating characteristic variable of said electric overpressure pump is the electric current thereof.

5. The method of claim 1, wherein the fill level of said tank is determined with at least one of the following: a fill level transducer; the quantity of fuel injected into said engine determined by an engine control system; contactless fill level sensor means; the road distance traveled by said vehicle; and, the weight of the tank.

6. A method for checking the operability of a vessel of a vehicle, the method comprising the steps of:

providing a pressure source and operatively connecting said pressure source to said vessel;

determining and storing a first fill level of said vessel at the start of a standstill of said vehicle;

introducing an overpressure relative to atmospheric pressure into said vessel during said standstill of said vehicle;

detecting an operating characteristic variable of said pressure source as said overpressure is introduced into said vessel;

drawing a conclusion as to the presence of a leak in said vessel from said operating characteristic variable;

determining and storing a second fill level of said vessel at the end of said standstill;

forming the difference of said first and second fill levels and determining whether said difference is less than a pregiven threshold value; and, only if said difference is less than said threshold values outputting a fault announcement.

7. The method of claim 6, wherein said vessel is part of a tank-venting system and said vehicle is a motor vehicle.

* * * * *

UNITED STATES PATENT AND TRADEMARK OFFICE

CERTIFICATE OF CORRECTION

PATENT NO. : 6,250,288 B1
DATED : June 26, 2001
INVENTOR(S) : Thorsten Fritz

It is certified that error appears in the above-identified patent and that said Letters Patent is hereby corrected as shown below:

Column 6,
Line 24, delete “values” and substitute -- value, -- therefor.

Signed and Sealed this

Eighteenth Day of February, 2003

JAMES E. ROGAN
*Director of the United States Patent and Trademark Office*